US009113255B2

(12) United States Patent
Araki et al.

(10) Patent No.: US 9,113,255 B2
(45) Date of Patent: Aug. 18, 2015

(54) HEADPHONES WITH OSCILLATOR FOR VIBRATING THE ARM PORTION

(71) Applicant: SONY COMPUTER ENTERTAINMENT INC., Tokyo (JP)

(72) Inventors: Takamasa Araki, Tokyo (JP); Kazuyoshi Murata, Tokyo (JP)

(73) Assignees: SONY CORPORATION, Tokyo (JP); SONY COMPUTER ENTERTAINMENT INC., Tokyo (JP)

( * ) Notice: Subject to any disclaimer, the term of this patent is extended or adjusted under 35 U.S.C. 154(b) by 156 days.

(21) Appl. No.: 13/903,073

(22) Filed: May 28, 2013

(65) Prior Publication Data

US 2013/0322676 A1 Dec. 5, 2013

(30) Foreign Application Priority Data

May 31, 2012 (JP) ..... 2012-125298

(51) Int. Cl.
*H04R 5/033* (2006.01)
*H04R 1/10* (2006.01)

(52) U.S. Cl.
CPC ..... *H04R 1/1091* (2013.01); *H04R 1/1041* (2013.01); *H04R 1/1066* (2013.01); *H04R 5/0335* (2013.01); *H04R 2420/07* (2013.01); *H04R 2420/09* (2013.01); *H04R 2430/01* (2013.01); *H04R 2460/03* (2013.01)

(58) Field of Classification Search
CPC .... H04R 5/033; H04R 5/0335; H04R 1/1066; H04R 1/10; H04R 1/1008
USPC ..... 381/370–384
See application file for complete search history.

(56) References Cited

U.S. PATENT DOCUMENTS

2010/0158265 A1* 6/2010 Riese ..... 381/74

FOREIGN PATENT DOCUMENTS

JP 2009-177574 8/2009

OTHER PUBLICATIONS

Machine Translation of Yamashita et al. Japanese Publication No. 2009-177574, Jun. 8, 2009.*
Notification of Reason for Refusal dated May 7, 2014 for corresponding Japanese Application No. 2012-125298.

* cited by examiner

*Primary Examiner* — Ahmad F Matar
*Assistant Examiner* — Katherine Faley
(74) *Attorney, Agent, or Firm* — Katten Muchin Rosenman LLP

(57) ABSTRACT

Headphones include a headband, an arm portion, a pair of headphone units that respectively retain a speaker, a hinge structure that supports the headphone unit at the arm portion, and an oscillator that vibrates the arm portion. The oscillator is contained in a transducer box and clamped and supported by the arm portion and the headband. A vibration conducting unit connects the arm portion with the headphone unit and conducts vibration of the arm portion to the headphone unit.

6 Claims, 10 Drawing Sheets

HEADPHONES WITH OSCILLATOR FOR VIBRATING THE ARM PORTION

BACKGROUND OF THE INVENTION

1. Field of the Invention

The present invention relates to headphones.

2. Description of the Related Art

Recent years, headphones wherein an oscillator that generates oscillation in accordance with audio signals is mounted on a hanger have been proposed (cf. patent document No. 1). According to the headphones proposed in the patent document No. 1, vibration generated by the oscillator is conducted to the entire headphones including a band. Therefore, vibration can be conducted to a large area on the head of a user in a balanced manner. In the patent document No. 1, an exemplary application of the headphones with an oscillator is shown where a user enjoys music from an MPEG Audio Layer-3 (MP3) player, or enjoys high quality sound effects of a game.

RELATED ART LIST

Patent Document

[Patent Documentl] Japanese Patent Application Publication No. 2009-177574.

An important problem to be solved by headphones with oscillator is to allow the vibration generated by an oscillator to be effectively conducted through to a user via a headband and an ear-pad. Further, the development of headphones with an oscillator with excellent aesthetic design is also one of the problems to be solved, since users have a strong interest not only in a functional aspect of a product but also in a design of the product.

SUMMARY OF THE INVENTION

The present invention addresses the aforementioned issue, and a purpose thereof is to provide headphones that allows vibration, which is generated by an oscillator, to be conducted to a user effectively. A further purpose of the present invention is to provide headphones with an oscillator with excellent design.

In order to address the aforementioned issue, headphones are provided according to an aspect of the present invention. The headphones include: an arm portion; a pair of headphone units that retain a speaker, respectively; a support unit operative to support the headphone unit at the arm portion; an oscillator operative to vibrate the arm portion; and a vibration conducting unit operative to conduct vibration of the arm portion to the headphone unit.

Optional combinations of the aforementioned constituting elements, and implementations of the invention in the form of methods, apparatuses, systems, computer programs, or the like may also be practiced as additional modes of the present invention.

DETAILED DESCRIPTION OF THE INVENTION

Mode for Carrying Out the Invention

The invention will now be described by reference to the preferred embodiments. This does not intend to limit the scope of the present invention, but to exemplify the invention.

Figure 1:
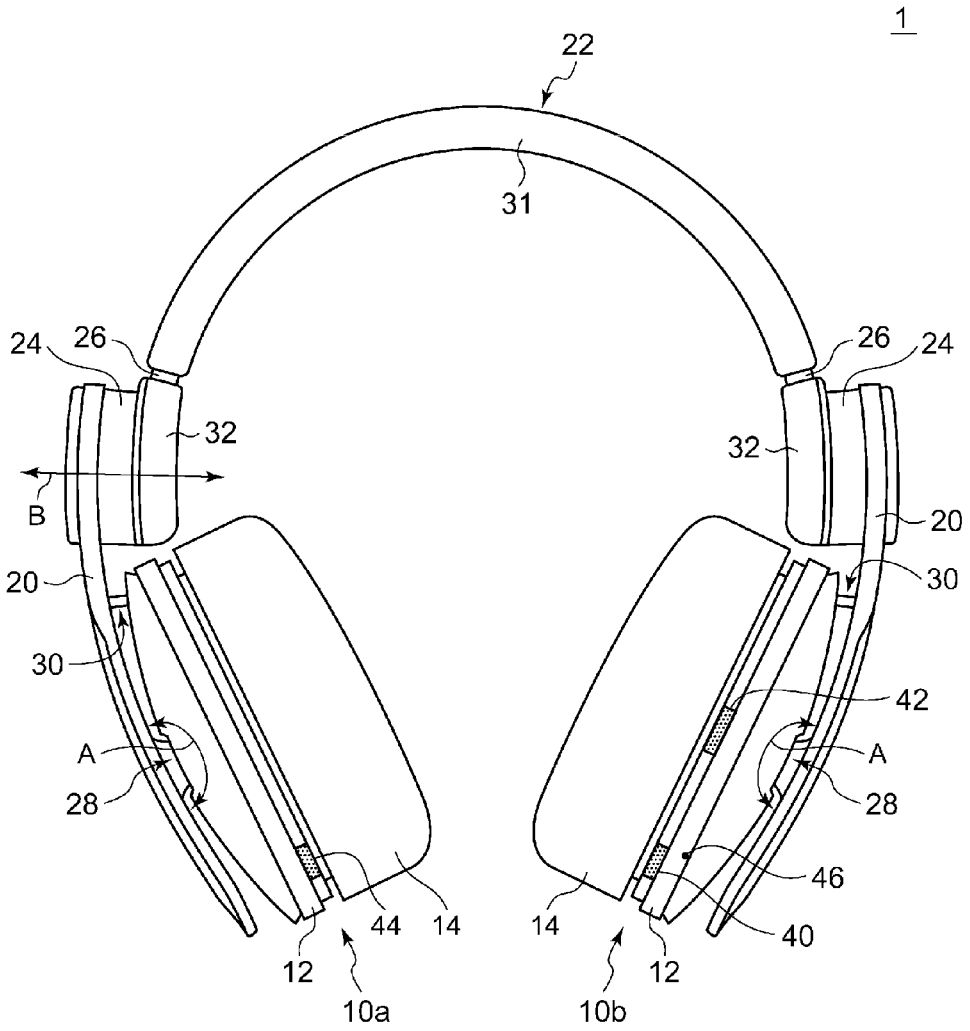
FIG. 1 shows a front view of headphones according to an exemplary embodiment.
Figure 2:
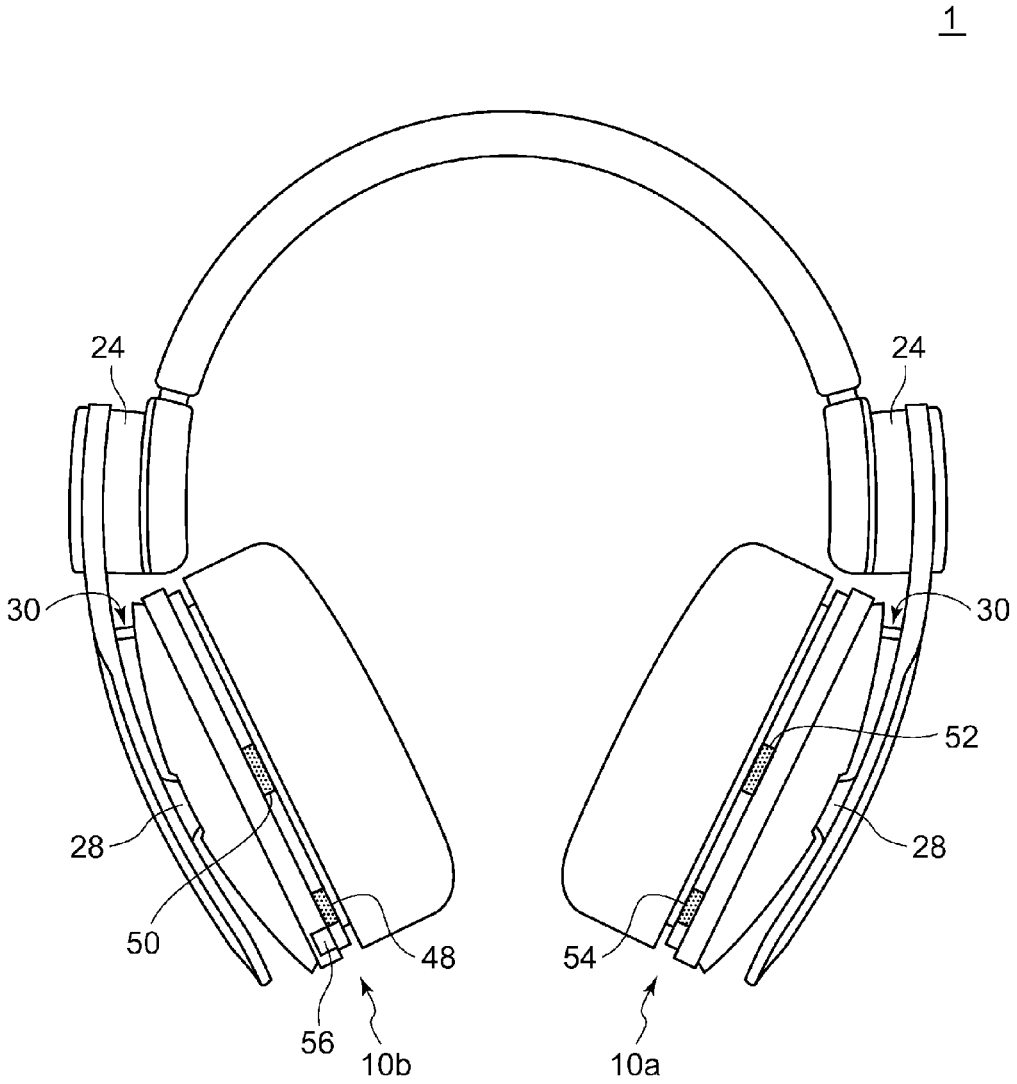
FIG. 2 shows a rear view of the headphones.
Figure 3:
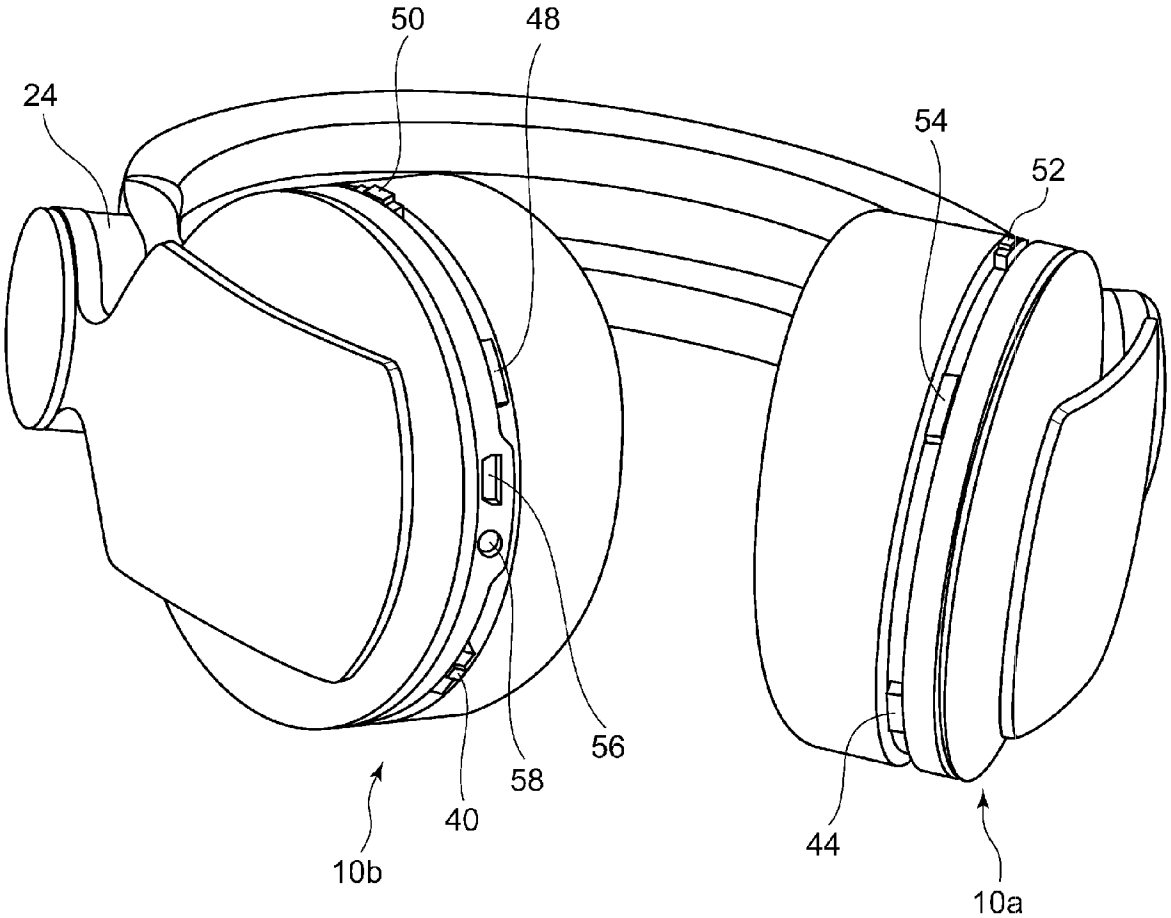
FIG. 3 shows a perspective view from the bottom of the headphones.

FIG. 1 shows a front view of headphones 1 according to an exemplary embodiment. FIG. 2 shows a rear view of the headphones 1, and FIG. 3 shows a perspective view from the bottom of the headphones 1. The headphones 1 according to the exemplary embodiment are provided with an oscillator that generates vibration and are capable of driving the oscillator in accordance with audio signals input to the headphones 1. The headphones 1 may be configured as a headset with a microphone (not shown). The headphones 1 are provided with a wireless communication function and are capable of receiving audio signals transmitted wirelessly from the outside and playing back the audio signals. With a cable plugged in, the headphones 1 are also capable of receiving audio signals via the cable and playing back the audio signals.

The headphones 1 comprise a headband 22, a pair of arm portions 20 that are connected to the both ends of the headband 22, a right ear headphone unit 10*a* and a left ear headphone unit 10*b* that are supported so as to be able to swing up and down relative to the pair of arm portions 20. Hereinafter, the right ear headphone unit 10*a* and the left ear headphone unit 10*b* may also be referred to as a "headphone unit 10," if there is no particular need to distinguish between the right ear headphone unit 10*a* and the left ear headphone unit 10*b*. The headphone unit 10 retains a speaker.

The headband 22 includes a band main body 31 that is formed into an arc-shaped curvature and is elastic. The headband 22 pinches the head of a user by using the elasticity, and presses the pair of headphone units 10 against the ears and the surrounding area of the user. The headband 22 is provided with sliders 26. One end of the slider 26 is slidably inserted into a slide hole on a slider adjusting unit 32. The slider adjusting unit 32 forms a part of the headband 22. By adjusting the insertion length of the slider 26 in accordance with the shape of the head of a user, the length of the headband 22 is adjusted. The functionality of the slider adjusting unit 32 may be provided by the band main body 31. That is, a slide hole may be formed on the band main body 31 and an end of a slider 26 may be inserted into the slide hole on the band main body 31.

A headphone unit 10 comprises a housing 12 that retains a speaker therein, and an ear pad 14 that is pressed against an ear and the surrounding area of a user. In the housing 12, a board on which a processor is installed is provided. This processor is provided with a function for outputting sound from the speaker or performing the drive control of the oscillator.

A headphone unit 10 is supported by a hinge structure 28 so as to be able to swing with respect to an arm portion 20. The hinge structure 28 is a supporting member that supports the headphone unit 10 at the arm portion 20. The hinge structure 28 supports the headphone unit 10 so that the headphone unit 10 can swing up and down relative to the arm portion 20. The hinge structure 28 includes a protruded portion that is fixed on and supported by the arm portion 20 in accordance with the exemplary embodiment. The protruded portion may be molded in one piece with the arm portion 20. Alternatively, the protruded portion that is a part separate from the arm portion 20 may be attached to the arm portion 20. The base of the protruded portion is fixed to the arm portion 20, and the tip of the protruded portion is rotatably attached to the housing 12. A shaft for supporting the tip of the protruded portion is formed on the housing 12 in the back and force direction of the headphones 1. By allowing the shaft formed on the housing 12 to rotatably support the tip of the protruded portion, the headphone unit 10 can swing up and down relative to the arm portion 20 as indicated by an arrow A about the shaft as a supporting point.

The hinge structure 28 may include a protruded portion that is fixed on the housing 12, the base of the protruded portion may be fixed to the housing 12, and the tip of the protruded portion may be rotatably attached to the arm portion 20. In this case, a shaft for supporting the tip of the protruded portion may be formed on the arm portion 20 in the back and force direction of the headphones 1. The headphone unit 10 may be configured so as to be able to swing up and down relative to the arm portion 20 about the shaft as a supporting point as indicated by the arrow A, by allowing the shaft formed on the arm portion 20 to rotatably support the tip of the protruded portion that extends from the housing 12.

The arm portion 20 and the headband 22 are connected with each other via a transducer box 24. An oscillator, which will be described later, is contained in the transducer box 24. The transducer box 24 is provided between the arm portion 20 and the headband 22 so that the vibration generated by the oscillator can be conducted effectively to the headband 22 and to the arm portion 20.

An explanation will be given on various manipulation means of the headphones 1. On the left ear headphone unit 10*b* is provided a power switch 40, which is a slide switch and is used in order to turn the power on or off. A mixer switch 42 is a slide switch and is used in order to adjust the balance between speaker volume and microphone volume. The mixer switch 42 can slide to the extent of a slide slot. In case that the mixer switch 42 positions at the center of the slide slot, the ratio between the speaker volume and the microphone volume is set to a predetermined value. If the mixer switch 42 slides to one side from the center, the ratio between the speaker volume and the microphone volume becomes larger than the predetermined value, and if the mixer switch 42 slides to the other side from the center, the ratio between the speaker volume and the microphone volume becomes smaller than the predetermined value.

A status LED 46 can emit light in a plurality of colors, (e.g., red, blue, green, or purple) and can notify a user of the status of the headphones 1 by the color of the emitted light. For example, red light indicates that the headphones 1 are being charged, blue light indicates that the headphones 1 are in wireless communication, green light indicates that the headphones 1 are in communication via a cable, and purple light indicates that the headphones 1 are muted.

The mute button 48 is used in order to control the microphone. There are two types of manipulation method for the mute button 48, namely, a short push and a long push. The short push switches whether or not the microphone is muted, and the long push switches whether or not to output sidetone, that is, whether or not to loop back the voice of a user. For example, the short push may be a pressing of a button for not more than one second, and the long push may be a pressing of a button for three seconds or more.

A volume switch 50 is a slide switch and is used in order to adjust the sound volume. The volume switch 50 can slide to the extent of a slide slot. If the volume switch 50 positions at one end of the slide slot, the volume is set to 0, and if the volume switch 50 positions at the other end of the slide slot, the volume is set to maximum. The volume switch 50 may be provided with a function to stop providing power to an oscillator 60 if the volume is set to 0.

A USB jack 56 is a slot for inserting a USB cable. If a USB cable is connected to the USB jack 56, a battery installed in the housing 12 is charged, the firmware of the processor is updated, etc.

A stereo jack 58 is a slot for inserting a stereo cable. The stereo jack 58 allows audio signals to input from an audio output apparatus via a cable. The audio output apparatus may be any apparatus that outputs audio signals, for example, an MPEG Audio Layer-3 (MP3) player, a Compact Disk (CD) player, a game device, a radio receiver, a television receiver, or the like. The headphones 1 are able to receive audio signals not only via a cable but also wirelessly.

Since the shape of the headphones 1 is substantially bilaterally symmetrical, a user sometimes wears the right ear headphone unit 10*a* and the left ear headphone unit 10*b* on the reverse ears respectively. The USB jack 56 and the stereo jack 58 is preferably provided on the bottom portion of the housing 12 so that a USB cable or a stereo cable to be connected will not annoy a user when the user wears the headphones 1 without taking into account which is the right or left thereof.

On the right ear headphone unit 10*a* is provided a surround button 44, which is used in order to turn a surround function on or off. A vibration level switch 52 is a slide switch and is used in order to adjust the level of vibration. The vibration level switch 52 can slide to the extent of a slide slot. If the vibration level switch 52 positions at one end of the slide slot, the vibration level is set to 0, and if the vibration level switch 52 positions at the other end of the slide slot, the vibration level is set to maximum. The vibration level switch 52 may be provided with a function to stop providing power to the oscillator 60 if the vibration level is set to 0.

A mode shift button 54 is used in order to switch vibration modes. Although detailed explanation will be described later, in brief, the oscillator is driven in accordance with audio signals in the headphones 1 according to the exemplary embodiment. However, a vibration trigger that serves as an impetus for driving the oscillator differs depending on vibration mode. Thus, the processor can detect a vibration trigger from audio signals in accordance with a set vibration mode, so that the processor can provide a user with a vibration that is appropriate to an audio signal to which the user listens.

Figure 4:
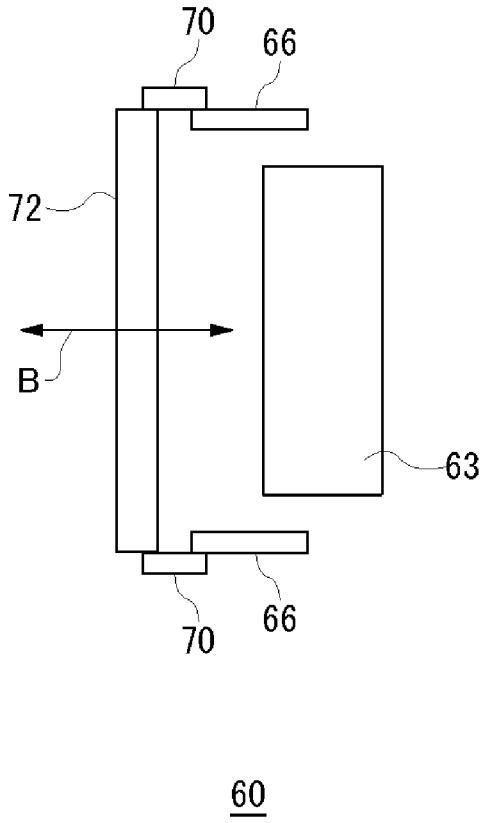
FIG. 4 shows a cross-sectional view of an oscillator provided in a transducer box.

FIG. 4 shows a cross-sectional view of an oscillator 60 provided in a transducer box 24. The oscillator 60 according to the exemplary embodiment is a dynamic oscillator to which the principle of a dynamic speaker is applied.

The oscillator 60 includes a magnet 63, a cylindrical coil 66, a diaphragm 72, and a surround 70 that fixes the coil 66 and the diaphragm 72 in an integrated fashion. The coil 66 is provided in a magnetic field generated by the magnet 63. If a drive current according to an audio signal is provided to the coil 66 from the outside, a drive force according to the drive current is given to the coil 66 in accordance with so-called Fleming's left hand rule. This drive force is exerted on the diaphragm 72 via the surround 70 so that the diaphragm 72 oscillates in the direction indicated by the arrow B as shown in FIG. 4. The surround 70 holds the diaphragm 72 in a manner where the diaphragm 72 can oscillate. The diaphragm 72 is configured by using a heavy material such as a brass so as not to emit a sound wave in the audibility range of human ear. A commonly used dynamic speaker is designed with a yoke that is provided in the vicinity of the magnet 63 and the coil 66 in order to provide a strong magnetic field for the coil 66. Also in the oscillator 60, a yoke may be provided as necessary, although not shown in FIG. 4.

The adoption of the dynamic oscillator 60 makes possible an oscillation and a pause with a resolution of several milliseconds level. For example, a beat timing of a drum sound, a bass sound, or the like in audio signals can be reflected more accurately. Further, an oscillation in synchronization with the waveform of an audio signal can be realized, which can provide a novel presentation where a user enjoys an undertone of music by vibration. In the oscillator 60 shown in FIG. 4, the magnet 63 is fixed and the coil 66 oscillates. However, the oscillator 60 may be a type where a coil is fixed and a magnet oscillates, which is, a so-called Moving Magnet (MM) type oscillator.

The oscillator 60 is contained in the cylindrical transducer box 24. The vibration of the oscillator 60 is conducted to the arm portion 20 and the headband 22 that are fixed directly to the transducer box 24. The oscillator 60 is provided between the arm portion 20 and the headband 22 so that the oscillator 60 can directly vibrate the arm portion 20 and the headband 22. Therefore, effective vibration conduction can be implemented. In the headphones 1 according to the exemplary embodiment, the outer side of the transducer box 24 in the direction from left to right or from right to left shown in FIG. 1 or FIG. 2 (i.e., the outer end of the cylindrical transducer box 24) is covered by the arm portion 20. If the transducer box 24 were not covered by the arm portion 20 and were positioned at the outermost end of the headphones 1 in the direction left to right or right to left, the outline of the headphones 1 would be a shape wherein the transducer boxes 24 would protrude in the direction from left to right or from right to left, which is not beautiful in design. In this fashion, the oscillator 60 is positioned between the arm portion 20 and the headband 22 in the headphones 1 so that both of the functionality of improved vibration conduction efficiency and improved aesthetic design are realized.

When wearing the headphones 1, a user adjusts the insertion length of the slider 26 into the slider adjusting unit 32 so that the length of the headband 22 matches the shape of the head of the user. In this process, the up/down angle of the pair of headphone units 10 is automatically adjusted by the hinge structure 28 so that the angle fits the slope of the sides of the head where the headphone units 10 press the ears of the user. Thus the pad surface of the ear pads 14 contact closely to the periphery of the ears so that sound escaping from the ear pads 14 is reduced as much as possible.

The headphones 1 according to the exemplary embodiment comprises a vibration conducting unit 30 that allows the vibration of the arm portion 20 to be conducted through to the headphone unit 10. The vibration conducting unit 30 couples the arm portion 20 with the headphone unit 10, whereby the vibration of the arm portion 20 is conducted to the headphone unit 10.

Figure 5:
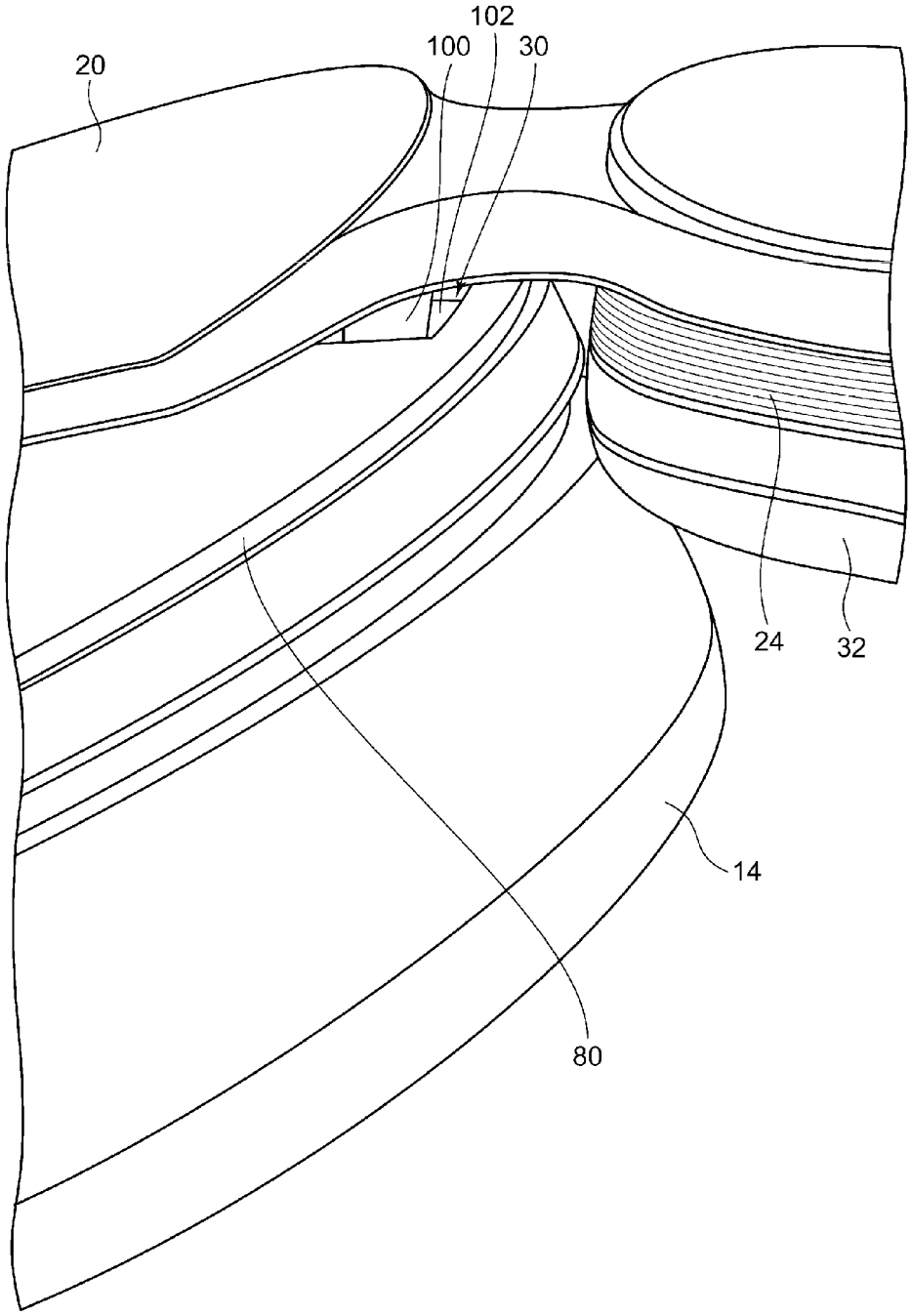
FIG. 5 is a diagram that illustrates a configuration of a vibration conducting unit.

FIG. 5 is a diagram that illustrates a configuration of the vibration conducting unit 30. The vibration conducting unit 30 comprises a protruded portion 100 that extends inwardly of the headphones 1 from the arm portion 20, and a catcher 102 that is provided in the housing 12. The protruded portion 100 may be formed in one piece with the arm portion 20. On the lid 80 of the housing 12, a through hole is formed. The tip of the protruded portion 100 passes through the through hole, contacts to the catcher 102, which is provided below the through hole, and stopped in an engaged state.

Figure 6:
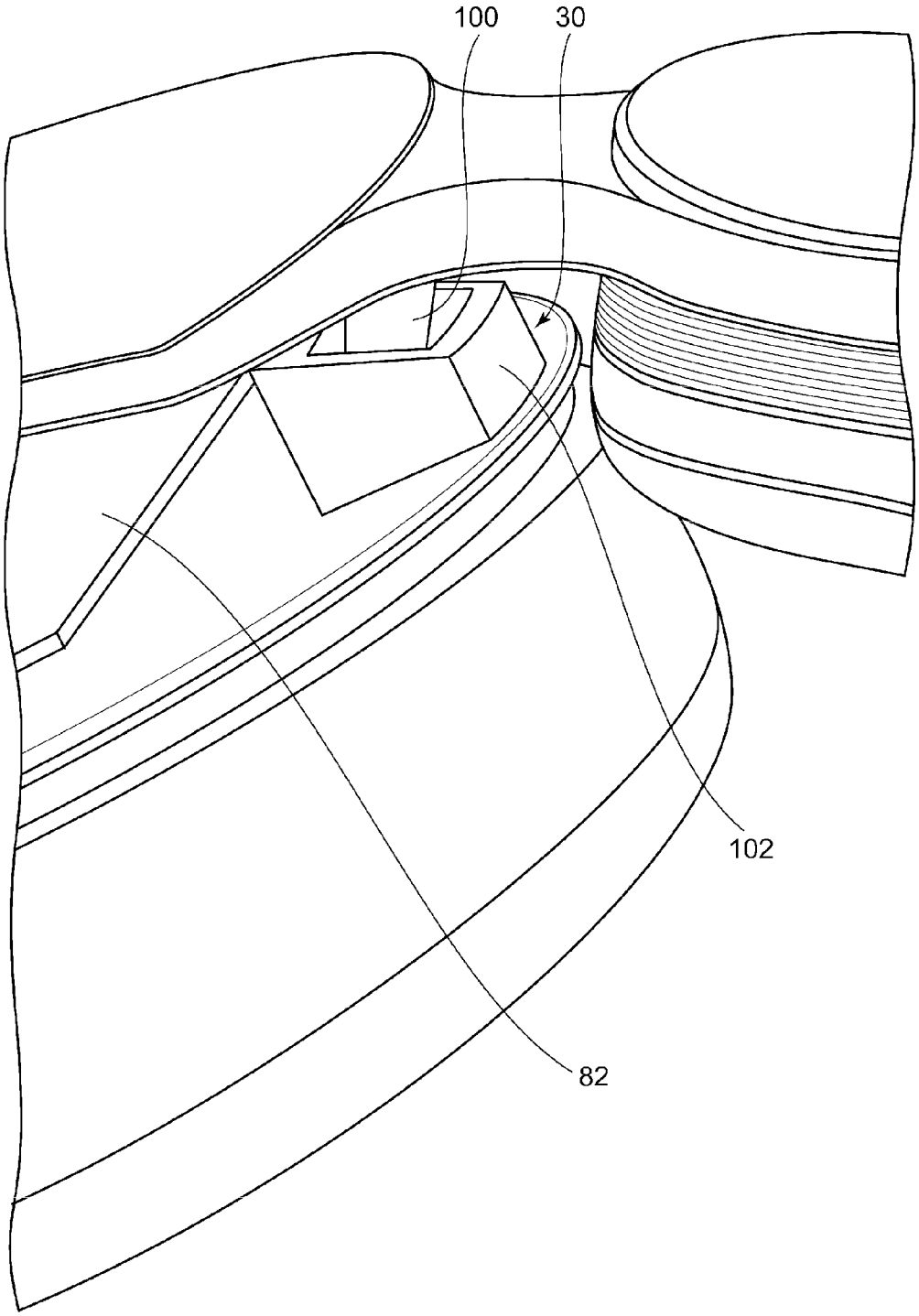
FIG. 6 shows the vibration conducting unit with a housing of which the lid is removed.

FIG. 6 shows the vibration conducting unit with the housing 12 of which the lid 80 is removed. The catcher 102 is made of elastic material and has a concave portion where the tip of the protruded portion 100 is inserted. The catcher 102 is substantially a rectangular-parallelepiped shaped rubber material with a concave portion on the center. The tip of the protruded portion 100 contacts the inner wall of the concave portion and stopped in an engaged state by frictional force acting between the tip and the inner wall.

If the relative positional relationship between the arm portion 20 and the headphone unit 10 changes, the protruded portion 100 will change the angle of insertion and the contact point in the concave portion. Since the catcher 102 is made of elastic material and is deformable, the inner wall of the concave portion that the protruded portion 100 contacts deforms in response to the movement of the protruded portion 100, and thus the protruded portion 100 can move in the concave portion.

The catcher 102 is shaped as a rectangular-parallelepiped rubber material of which the central portion is bored. However, the shape is to retain the strength of the catcher 102 against the pressing force of the protruded portion 100. Therefore, the shape of the catcher 102 is not limited to this. For example, a contact portion that the protruded portion 100 contacts may be formed as a vertically arranged wall in the housing 12 and the wall may constitute the catcher 102 if the strength is ensured.

Figure 7:
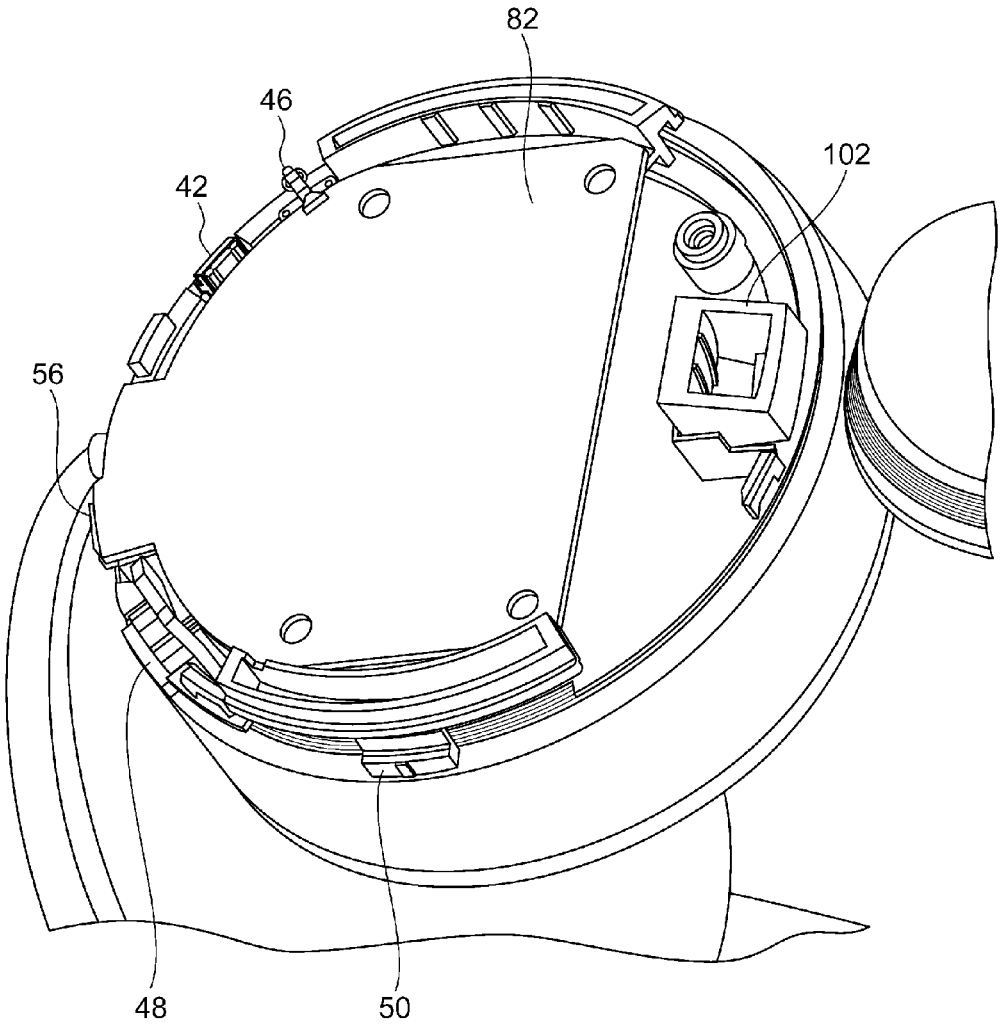
FIG. 7 shows the inner structure of the housing.

FIG. 7 shows the inner structure of the housing 12. A board 82 is provided in the housing 12, and a processor (not shown) is installed on the board 82. FIG. 7 shows the inner structure of the left ear headphone unit 10*b*. The processor installed on the board 82 receives signals indicating various status values relating to on or off, various status quantities, or the like from the power switch 40, the mixer switch 42, the status LED 46, the mute button 48, the volume switch 50 and the USB jack 56, and executes default setting and a process.

Figure 8A:
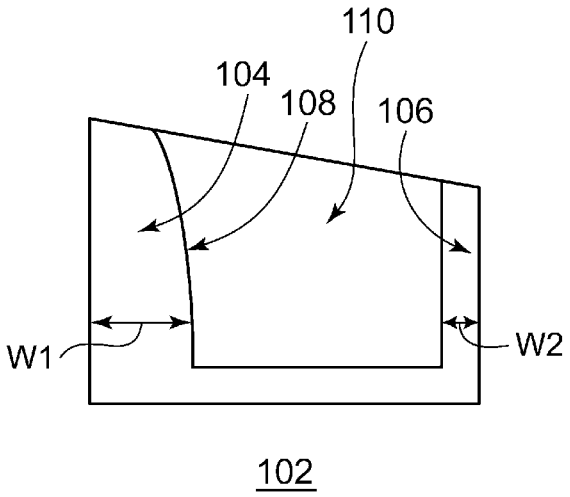
FIG. 8A shows a sectional side view of a catcher and FIG. 8B shows a perspective view of a contact surface.

FIG. 8A shows a sectional side view of the catcher 102. The catcher 102 is made, for example, of rubber and is deformable in response to the pressing force of the protruded portion 100. The tip of the protruded portion 100 contacts a contact surface 108 of a contact portion 104. When the relative positional relationship between the arm portion 20 and the headphone unit 10 changes and the protruded portion 100 moves in the concave portion 110, the contact portion 104 deforms in the direction of the thickness thereof so that the contact status between the protruded portion 100 and the contact portion 104 is maintained. In this fashion, the protruded portion 100 and the contact portion 104 always keep the contact status, and the vibration on the arm portion 20 is conducted to the catcher 102.

If comparing the thickness of the contact portion 104 and the thickness of the facing portion 106 that is at a position opposite to the contact portion 104, the thickness W1 of the contact portion 104 is larger than the thickness W2 of the facing portion 106. Since the protruded portion 100 does not contact the facing portion 106, the thickness W2 is not required to be increased. On the other hand, since the protruded portion 100 contacts the contact portion 104, it is preferable to increase the thickness W1 so as to ensure a certain degree of deformation of the contact portion 104 in accordance with the movement of the protruded portion 100.

Figure 8B:
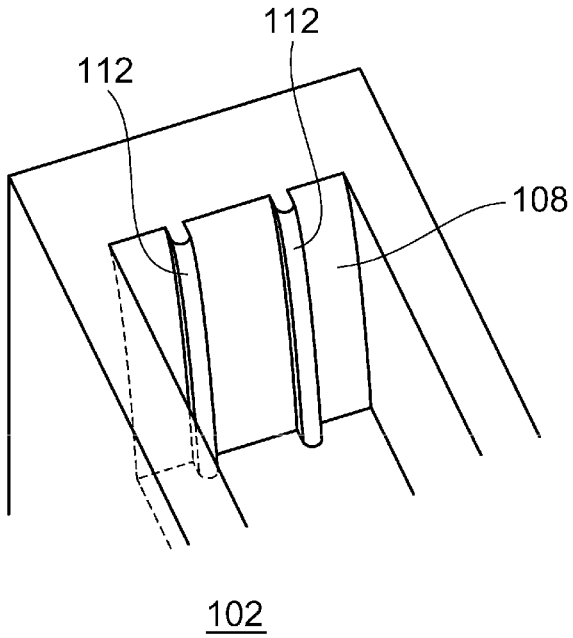

FIG. 8B shows a perspective view of the contact surface 108. On the contact surface 108, two guide ribs 112 that run from the upper surface to the lower surface of the contact portion 104 are formed. The tip of the protruded portion 100 moves in a region between the two guide ribs 112. The degree of freedom of the hinge structure 28 is one. Therefore, the movement of the tip of the protruded portion 100 is constrained to a predetermined line on the contact surface 108. The provision of the pair of guide ribs 112 on the contact surface 108 can confine unexpected movement of the tip of the protruded portion 100.

Figure 9A:
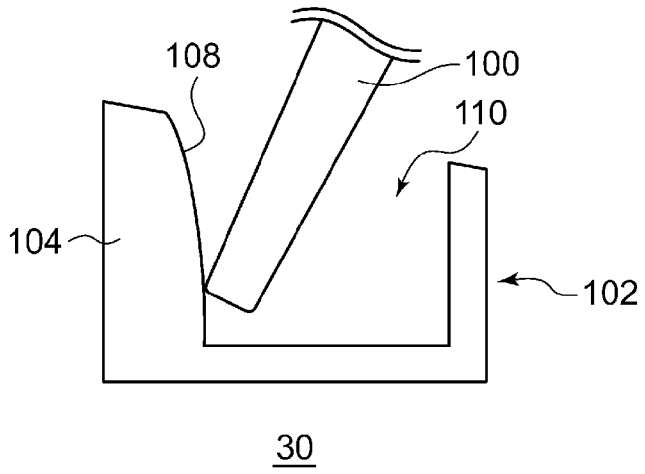
FIGS. 9A and 9B schematically show a state where a protruded portion and a contact portion have contact with each other.
Figure 9B:
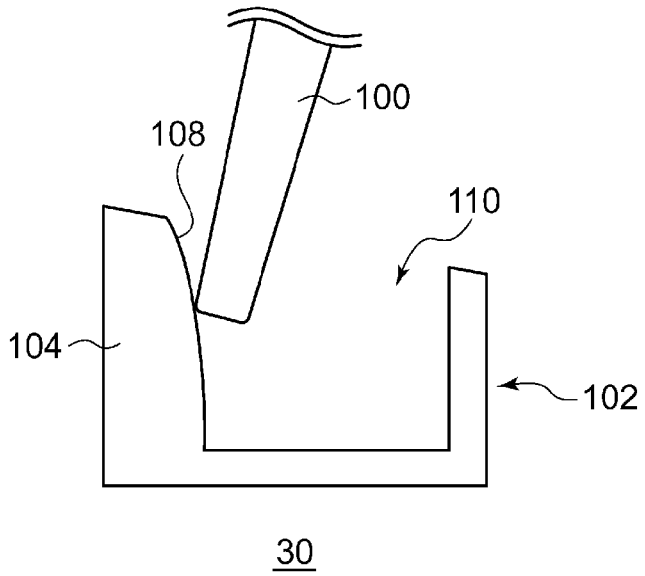

FIGS. 9A and 9B show a state where the protruded portion 100 and the contact portion 104 have contact with each other. The protruded portion 100 always maintains the contact with the contact portion 104. If a relative position (relative angle) of the headphone unit 10 with respect to the arm portion 20 changes, the angle of insertion of the protruded portion 100 with respect to the concave portion 110 and the contact point (contact position) of the tip of the protruded portion 100 with the contact surface 108 change.

FIG. 9A shows a contact state where the upper portion of the headphone unit 10 moves closer to the protruded portion 100, and the protruded portion 100 and the catcher 102 position closer to each other. The distance between the protruded portion 100 and the catcher 102 becomes shorter, whereby the angle of insertion of the protruded portion 100 with respect to the concave portion 110 becomes shallower and the tip of the protruded portion 100 contacts the contact surface 108 at the lower part thereof. On the contrary, FIG. 9B shows a state where the upper portion of the headphone unit 10 moves relatively away from the protruded portion 100. The distance between the protruded portion 100 and the catcher 102 becomes longer, whereby the angle of insertion of the protruded portion 100 with respect to the concave portion 110 becomes deeper and the tip of the protruded portion 100 contacts the contact surface 108 at the upper part thereof. The contact portion 104 has flexibility, whereby the vibration conducting unit 30 allows the protruded portion 100 and the contact portion 104 to always keep contact with each other, and couples the arm portion 20 and the headphone unit 10 while maintaining a state where the headphone unit 10 can swing with respect to the arm portion 20. This allows the vibration conducting unit 30 to allow the vibration of the arm portion 20 to be conducted through to the headphone unit 10 no matter what attitude the headphone unit 10 takes with respect to the arm portion 20.

As described above, the catcher 102 is required to have elasticity in order to maintain the contact with the protruded portion 100 that moves in the concave portion 110. However, excessively high elasticity of the catcher 102 might cause the damping of vibration, which is conducted from the arm portion 20, at the catcher 102. Therefore, the catcher 102 is preferably formed with a rubber hardness that allows the vibration, which is conducted from the protruded portion 100, to be conducted through to the housing 12 without damping as much as possible, and meanwhile, that allows the tip of the protruded portion 100 to slide on the contact surface 108 of the catcher 102.

The hinge structure 28 according to the exemplary embodiment pivotally supports the headphone unit 10. Therefore, the headphone unit 10 can swing in the direction as indicated by an arrow A. Assuming headphones without the vibration conducting unit 30, if vibration input by the oscillator 60 to the arm portion 20 is conducted from the hinge structure 28 through to the headphone unit 10, a part of the vibration is consumed as external force for swinging the headphone unit 10. Thus the ear pad 14 can not be vibrated efficiently.

Therefore, the headphones 1 according to the exemplary embodiment is configured so that vibration input to the arm portion 20 is appropriately conducted through to the headphone unit 10 by the vibration conducting unit 30. In the vibration conducting unit 30, the contact point between the protruded portion 100 and the contact portion 104 is not moved by vibration of the arm portion 20 because of a frictional force between the protruded portion 100 and the contact portion 104. In this manner, since the protruded portion 100 and the contact portion 104 come to rest by a frictional force, vibration on the arm portion 20 is conducted efficiently through the vibration conducting unit 30 to the headphone unit 10. In case that a user puts the headphones 1 on his/her head, a frictional force caused by a contact between the protruded portion 100 and the contact portion 104 acts as a burden (friction) when changing the relative positional relationship between the arm portion 20 and the headphone unit 10. However, because of the elasticity of the contact portion 104, the frictional force is not so heavy a burden and thus the user can change the relative angle between the arm portion 20 and the headphone unit 10.

In this manner, a coefficient of friction between the protruded portion 100 and the contact portion 104 is set so that the contact point between the protruded portion 100 and the contact portion 104 is not moved by vibration of the arm portion 20. On the other hand, the coefficient of friction is set so that the relative rotational motion of the headphone unit 10 at the hinge structure 28 is not hindered when a user puts the headphones 1 on his/her head. This allows vibration on the arm portion 20 to conduct efficiently through the vibration conducting unit 30 to the headphone unit 10 when the headphones 1 are worn on the head of a user. Thus a desired vibration can be provided to the user. In this process, the relative positional relationship between the arm portion 20 and the headphone unit 10 is fixed by the vibration conducting unit 30. Therefore, the vibration conduction efficiency of the arm portion 20 through the hinge structure 28 is also improved.

The present inventor has found, through a trial and error process, that the vibration conducting unit 30 is preferably provided at a position nearer to the oscillator 60 than to the hinge structure 28, from the viewpoint of vibration conducting efficiency. The vibration conducting unit 30 couples the arm portion 20 with the headphone unit 10, more rigidly than the hinge structure 28. Therefore, the present inventor found out that increasing the vibration component to be conducted from the vibration conducting unit 30 to the headphone unit 10 improves the vibration conduction efficiency of the headphones 1 as a whole. Thus, the vibration conducting unit 30 is preferably provided at a position nearer to the oscillator 60 than to the hinge structure 28 in the arm portion 20 and in the headphone unit 10. Although one vibration conducting unit 30 is provided in each of the headphone units 10 according to the exemplary embodiment, a plurality of vibration conducting units 30 may be provided.

Although the protruded portion 100 is provided in the arm portion 20 and the catcher 102 is provided in the headphone unit 10 as the structure of the vibration conducting unit 30 according to the exemplary embodiment, the vibration conducting unit 30 may be configured in a reverse way. That is, the catcher 102 may be provided in the arm portion 20 and the protruded portion 100 may be provided in the headphone unit 10. Although an explanation has been given that the catcher 102 is made of elastic material, the protruded portion 100 may be made of elastic material. An explanation has been given that the contact point between the protruded portion 100 and the catcher 102 is fixed (is not moved) by a frictional force between the protruded portion 100 and the catcher 102 in the vibration conducting unit 30. However, the vibration conducting unit 30 may be configured so that the contact point is fixed by applying, for example, a spring load or the like.

Figure 10:
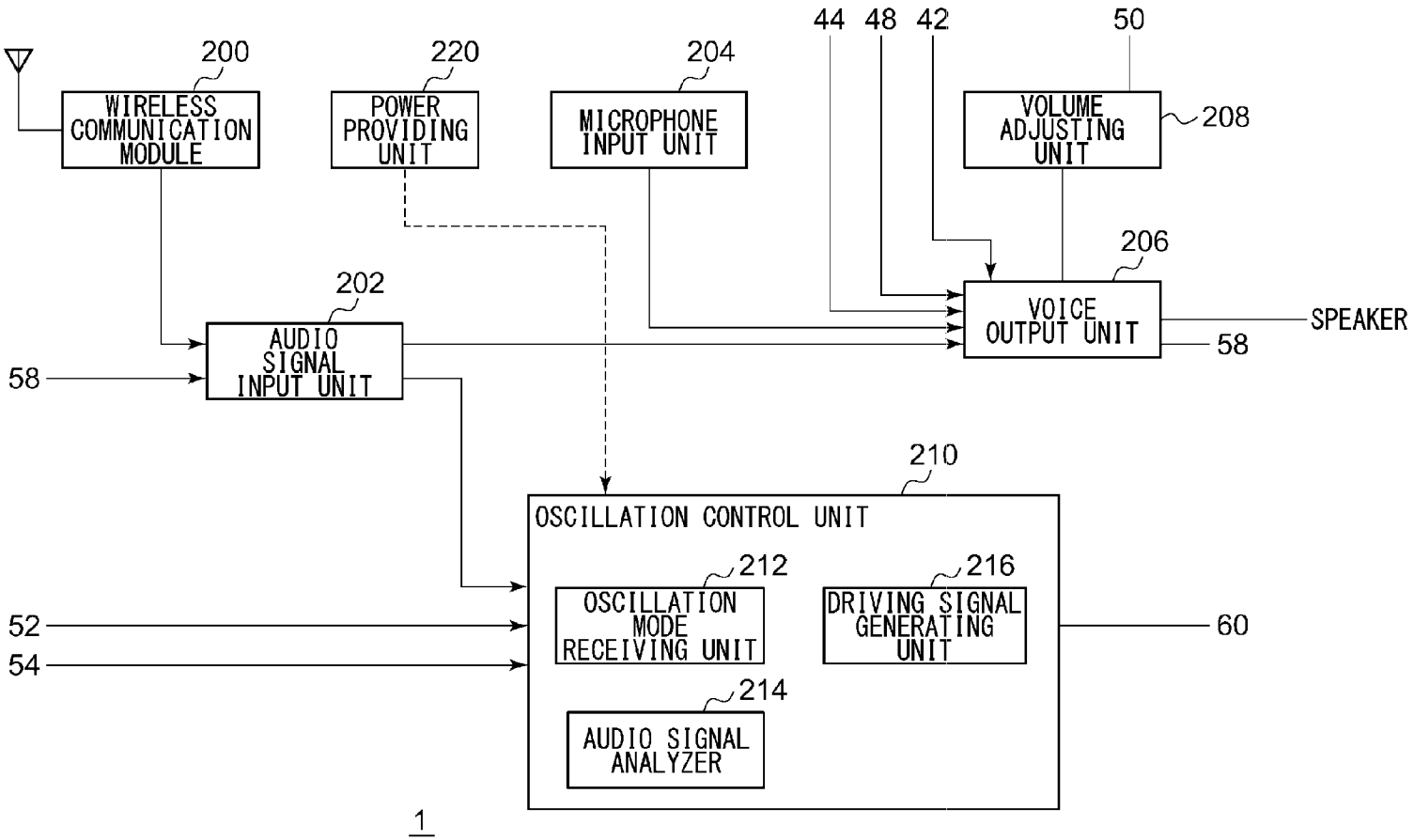
FIG. 10 shows functional blocks of the headphones.

FIG. 10 shows functional blocks of the headphones 1. FIG. 10 shows a configuration for outputting sound and controlling oscillation. The headphones 1 comprises a wireless communication module 200, an audio signal input unit 202, a microphone input unit 204, a voice output unit 206, a volume adjusting unit 208, an oscillation control unit 210, and a power providing unit 220. The wireless communication module 200 is provided with a wireless communication function using, for example, Bluetooth (registered trademark) protocol communication, and acquires an audio signal from an audio output apparatus over the air. The audio signal input unit 202 receives an audio signal acquired by the wireless communication module 200 or an audio signal transmitted from the audio output apparatus by a cable via the stereo jack 58. The microphone input unit 204 receives a voice of a user who wears the headphones 1, the voice having been input from the microphone (not shown). The power providing unit 220 supplies power to respective functional blocks.

The elements shown in FIG. 10 are implemented by a CPU of a computer, memory, a program loaded into the memory, or the like in terms of hardware components. FIG. 10 depicts functional blocks implemented by cooperation of these components. Therefore, it will be obvious to those skilled in the art that the functional blocks may be implemented in a variety of ways, by hardware only, software only, or a combination thereof.

The volume adjusting unit 208 adjusts the volume of sound output from the speaker in accordance with the sliding position of the volume switch 50. The voice output unit 206 determines whether or not to generate surround sounds in accordance with the status value of the surround button 44. The voice output unit 206 receives a microphone input from the microphone input unit 204 and determines whether or not to mute the microphone input in accordance with the status value of the mute button 48, or whether or not to perform a sidetone function for microphone sound. In case that microphone sound is not muted, the voice output unit 206 determines the speaker volume and the microphone volume in a ratio determined by the mixer switch 42. Under the setting described in the foregoing, the voice output unit 206 converts audio signals received from the outside to sounds so as to output the sounds from the speaker, and transmits the microphone sounds to a predetermined terminal device from the stereo jack 58 or from the wireless communication module 200.

The oscillation control unit 210 is provided with an oscillation mode receiving unit 212, an audio signal analyzer 214, and a driving signal generating unit 216. The oscillation mode receiving unit 212 receives a vibration mode set through the mode shift button 54. According to the exemplary embodiment, a plurality of vibration modes are provided. For example, a beat mode for vibration in accordance with a beat in audio signals, a game mode for vibration in accordance with a predetermined sound in game sounds.

The audio signal analyzer 214 analyzes audio signals in accordance with a vibration mode received by the oscillation mode receiving unit 212. In the beat mode, the audio signal analyzer 214 calculates a spectrum for respective times by a commonly used method, for example, by calculating the Fast Fourier Transform (FFT) of audio signals at predetermined time intervals. Then the audio signal analyzer 214 calculates the differential value of the spectrum with respect to time by calculating a change per unit of time of the summation of the spectrum over all of the frequency bands. This calculation may in practice be performed by an overlap process wherein a spectrum is calculated for each group of audio signals sampled within a predetermined time slot, and the difference between the spectrum and another spectrum, which is calculated by shifting the time slot by a unit of time, is acquired as a differential value with respect to time. In this manner, spectra can be acquired with a resolution of several milliseconds to several tens of milliseconds. The audio signal analyzer 214 compares the peak value of the waveform in spectra obtained in the aforementioned manner with a predetermined threshold, and extracts as a beat component a waveform having a peak that surpasses the threshold.

In a game mode, audio signals that are typical of games are extracted. For example, the audio signal analyzer 214 detects the sound of a footstep of a game character included in audio signals. The audio signal analyzer 214 analyzes the spectrum of audio signals, and detects whether or not the frequency component of the sound of a footstep exist. For example, the frequency component of the sound of a footstep is registered in the audio signal analyzer 214 beforehand, and the audio signal analyzer 214 detects whether or not a frequency component of the sound of a footstep is included in the spectrum of audio signals. Although this is an example where the sound of a footstep of a game character is detected from game sounds, a sound of an explosion, a sound of a gunshot, or the like in a game may be detected.

Upon receiving the result of analysis by the audio signal analyzer 214, the driving signal generating unit 216 generates a driving signal for driving the oscillator 60. The audio signal analyzer 214 provides an oscillation signal that indicates timing to oscillate the oscillator 60 and the level of oscillation to the driving signal generating unit 216. Based on the oscillation signal, the driving signal generating unit 216 provides a driving signal to the oscillator 60. Thereby, the headphones 1 can provide a user with a vibration that is appropriate to an audio signal in accordance with a vibration mode.

Although FIG. 10 indicates that the power providing unit 220 supplies power to the oscillation control unit 210, the power providing unit 220 supplies power to other elements as well, such as, the voice output unit 206 or the like. In the headphones 1, the oscillator 60 is oscillated in accordance with audio signals. In case that the volume of sounds from the speaker is set to 0, the oscillator 60 is not required to be oscillated. Therefore, if the speaker volume is set to 0 by the volume switch 50 or the mixer switch 42, the power providing unit 220 may stop power supply to the oscillation control unit 210 or to the oscillator 60 so as not to oscillate the oscillator 60. This can reduce unnecessary power consumption.

Given above is an explanation based on the exemplary embodiment. The embodiment is intended to be illustrative only and it will be obvious to those skilled in the art that various modifications to constituting elements and processes could be developed and that such modifications are also within the scope of the present invention.

According to the exemplary embodiment, the stiffness of the band portion of the headphones 1 is adjusted by the headband 22 and the arm portion 20. As a variation, the slider adjusting unit 32 and the arm portion 20 may be formed as a one piece structure so that the stiffness of the band portion can be adjusted. Alternatively, a part separate from a band portion, which comprises the headband 22 and the arm portion 20, may further be added to the band portion. Alternatively, the thickness of the headband 22, the arm portion 20, the slider adjusting unit 32, and/or the transducer box 24 may be adjusted. Alternatively, the headband 22, the arm portion 20, the slider adjusting unit 32, and/or the transducer box 24 may be formed as hollow or may be made of appropriately-selected material. Thereby, the stiffness of the band portion is adjusted, and the vibration conduction efficiency is increased.

What is claimed is:

1. Headphones comprising:

an arm portion;

a pair of headphone units that retain a speaker, respectively;

a support unit operative to connect a headphone unit of the pair of headphone units to the arm portion;

an oscillator operative to vibrate the arm portion; and a vibration conducting unit provided separately from the support unit and operative to conduct vibration of the arm portion to the headphone unit, wherein the support unit supports the headphone unit so that the headphone unit can swing with respect to the arm portion;

wherein the vibration conducting unit includes;

a protruded portion extending inward from the arm portion and contacts a catcher having a curved contact surface located on the headphone unit, wherein the protruded portion maintains contact with the curved contact surface as the headphone unit swings with respect to the arm portion.

2. The headphones according to claim 1, wherein the vibration conducting unit connects the arm portion with the headphone unit while maintaining a state where the headphone unit can swing with respect to the arm portion.

3. The headphones according to claim 1, wherein at least one of the protruded portion and the curved contact surface is made of elastic material.

4. The headphones according to claim 1, wherein the protruded portion maintains contact with the curved contact surface even when the arm portion vibrates because of a frictional force caused by a contact between the protruded portion and the curved contact surface.

5. The headphones according to claim 1 further comprising a headband, wherein the oscillator is provided between the arm portion and the headband.

6. Headphones comprising:

an arm portion;

a pair of headphone units that retain a speaker, respectively;

a support unit operative to connect a headphone unit of the pair of headphone units to the arm portion;

an oscillator operative to vibrate the arm portion; and a vibration conducting unit provided separately from the support unit and operative to conduct vibration of the arm portion to the headphone unit, wherein the support unit supports the headphone unit so that the headphone unit can swing with respect to the arm portion:

wherein the vibration conducting unit includes:

a protruded portion extending outward from the headphone unit portion and contacts a catcher having a curved contact surface located on the arm portion, wherein the protruded portion maintains contact with the curved contact surface as the headphone unit swings with respect to the arm portion.

* * * * *